US006274209B1

(12) United States Patent
Pagidas et al.

(10) Patent No.: US 6,274,209 B1
(45) Date of Patent: Aug. 14, 2001

(54) SEMIPERMEABLE VENTING CLOSURE

(75) Inventors: Jannis Pagidas, Metamorfosis; Efstathios Koklas, Koropi; Alexis Stassinopolous, P. Faliron, all of (GR)

(73) Assignee: Argo AG Plastic Packaging, Koropi (GR)

( * ) Notice: Subject to any disclaimer, the term of this patent is extended or adjusted under 35 U.S.C. 154(b) by 0 days.

(21) Appl. No.: 09/168,494

(22) Filed: Oct. 8, 1998

Related U.S. Application Data

(63) Continuation-in-part of application No. 09/145,358, filed on Sep. 1, 1998, now abandoned.

(30) Foreign Application Priority Data

Jun. 25, 1998 (GR) ..... 980200103

(51) Int. Cl.[7] ..... B65D 51/16; B65D 81/26

(52) U.S. Cl. ..... 428/35.7; 428/36.4; 428/36.5; 206/204; 220/371; 220/521; 220/522; 215/227; 215/261; 215/308

(58) Field of Search ..... 428/35.7, 36.5, 428/36.4, 34.5; 206/204; 220/521, 522, 371; 215/308, 227, 261

(56) References Cited

U.S. PATENT DOCUMENTS

| | | | | |
|---|---|---|---|---|
| 254,718 | * | 3/1882 | Smyth | 215/308 |
| 2,317,882 | * | 4/1943 | Boesel | 215/227 |
| 3,035,730 | * | 5/1962 | Walker et al. | 215/308 |
| 3,081,137 | * | 3/1963 | Kolokythas | 220/522 |
| 3,961,724 | * | 6/1976 | Kapsy | 220/371 |
| 3,990,872 | * | 11/1976 | Cullen | 206/204 |
| 4,146,277 | * | 3/1979 | Santoro | 206/204 |
| 4,254,530 | * | 3/1981 | Lambert | 15/235 |
| 4,725,465 | * | 2/1988 | Lastovich | 206/204 |
| 4,748,069 | * | 5/1988 | Cullen | 206/204 |
| 4,765,499 | * | 8/1988 | von Reis et al. | 220/371 |
| 4,884,716 | * | 12/1989 | Steiner | 220/371 |
| 5,356,678 | * | 10/1994 | Heitzhaus et al. | 428/35.6 |
| 5,725,645 | * | 3/1998 | Wickland et al. | 220/371 |
| 5,830,543 | * | 11/1998 | Miyake et al. | 206/204 |

* cited by examiner

*Primary Examiner*—Rena L. Dye
(74) *Attorney, Agent, or Firm*—Walter C. Farley

(57) ABSTRACT

A venting cap (1) has a cavity (7), at least one first passage (4) for fluids connecting the cavity (7) with the inside of the container, at least one second passage (5.1, 5.2, 5) for fluids connecting the cavity (7) with the outside of the container, and a liquid-absorbing mass (8) arranged within the cavity (7). The liquid-absorbing mass (8) acts, after absorption of liquid, as a selective filter prohibiting the passage of liquid, but permits the passage of gas. This ensures the foolproof selective permeation of gas but not of liquid. Venting properties remain unaltered even at extreme conditions of transportation and storage.

10 Claims, 2 Drawing Sheets

SEMIPERMEABLE VENTING CLOSURE

CROSS-REFERENCE TO RELATED APPLICATION

This application is a continuation-in-part of application Ser. No. 09/145,358 filed Sep. 1, 1998 now abandoned.

FIELD OF THE INVENTION

The present invention relates to a semipermeable venting cap to permit the selective passage of gases but not of liquids, suitable to seal plastic bottles containing liquids which could create positive or negative pressure by producing gaseous products or by absorbing air from the headspace, and to compensate pressure differences. Examples of such liquids are housecleaning and sanitation solutions, cosmetics, biochemicals, agrochemicals, beverages and liquid food products. The creation of positive or negative pressure in the plastic container causes unwanted deformation of the container.

BACKGROUND OF THE INVENTION

Venting caps must be able to function properly in a wide span of end uses and storage and transportation conditions. For a wide group of consumer packages the following major prerequisites are required: (a) The caps must vent air at low pressure difference built-up. (b) They must not permit liquid exit even at high pressure built-up in the container. (c) They must retain these properties in the most extreme conditions of transportation and storage. (d) Their cost of production must be low and the materials and parts required for their manufacturing must be readily available. From the evaluation of vented cap technology available at present it was found that in all cases the vented caps proposed or offered in the market do not conform sufficiently to one or more of the above prerequisites.

The following arrangements have been tried to overcome this problem.

A first attempt was the creation of plastic bottles with very thick walls and specially design features to prevent deformation. Such bottles are expensive and environmentally unsuitable because of the need to use excessive plastic material (see for example Packaging Techn. & Sci., 6(1993), 23–29).

A second attempt was the capping of the bottles with caps fitted with porous semipermeable membranes, which permit the passage of gases but not of liquids. The caps have suitable openings permitting the gas to exit to the environment. The major problem of this arrangement consists in the need of a much higher pressure difference to guarantee functionality when the membrane is wet. Such caps are described in the following patents and patent applications: EP-0 408 378 (W. L. Gore), WO 94/26614 (Procter & Gamble), WO 94/22553 (W. L. Gore), DE-2 341 414 (Hesser). There are two main problems related to such caps. One is the high cost of the semipermeable membrane used and the limited sources of their supply. The other and most important problem is that when the membranes come in contact with the liquid contents (which almost always happens when the packages are transported or stored in a tilted or horizontal position) there is a change in their permeation characteristics. Thus, instead of permitting the gases to flow at low pressure differences, the once moistened membranes require much higher pressure differences to permit gas flow. There are cases where a membrane is specified to permit gas flow at 5 mbar pressure difference which rises to 250 mbar when the membrane is wetted. To overcome this second problem, a protective cap of the membrane is proposed in EP-0 110 046 (Rhein-Conti) and in Greek patent application 960100443. Such attempts increase excessively the cost of caps.

A third attempt was the use of caps containing an outlet covered by an elastic membrane with a thin split which would permit the exit of gas above certain pressure but was impermeable to the liquid contents. Such caps are described in EP-0 555 623, GB-1 534 570, U.S. Pat. No. 5,143,236 (L'Oreal), U.S. Pat. No. 4,896,789 and Greek patent application 96011443. The drawback of such caps is the lack of complete selectivity in permitting the exit of gas but not of the liquid. Normally, one can see liquid bubbles coming out of such caps during storage. It has been found in our experiments that the size and shape of the slit, the geometry of the elastic membrane, and the characteristics of the elastic material of the membrane are so critical that even the slightest deviation creates this non-selectivity problem.

A fourth attempt uses caps containing an inside elastic sealing disc, seated on a ribbed or grooved non-flat surface on the underside of the cap. In theory a gas under pressure inside the bottle deforms the elastic disc and escapes through the openings created between the deformed disc and the non flat surface of the cap (U.S. Pat. No. 5,242,069 (Henkel), DE-3 611 089 (Henkel), WO 94/13549 (Wazel), EP-0 241 780 (Henkel), U.S. Pat. No. 5,457,943 (Hertramf)). The main drawback in such caps, in addition to their non-selectivity, is the fact that very high pressure differences are required to deform the disc (200 mbar or more). At such high pressures the plastic bottle is already deformed before the escape of gas.

SUMMARY OF THE INVENTION

An object of the present invention is to overcome the above limitations of the up to now existing venting caps.

The herein disclosed cap is designed to permit gas escape from the contents to the environment and vice versa at very low pressure differences, even when the cap is wet. At the same time the cap is not permeable to liquid even at high pressure differences. The distinguishing characteristic of the venting cap described in the present invention is the foolproof selective permeation of gas but not of liquid. The venting properties of such a cap remain unaltered even at extreme conditions of transportation and storage. This selective permeation is achieved by forcing the fluid contents, liquid or gas, to pass through a swellable liquid-absorbing mass comprising a polymeric matrix before finding an outlet to the outside environment. No liquid is permitted to pass through this polymeric matrix after its expansion by absorption of water, contrary to the free passage of gas. The selective free passage of gas is further improved by the inclusion of granules of a porous material in the swollen polymeric mass.

The venting cap according to the invention comprises a cavity, at least one first passage for fluids connecting the cavity with the inside of the container, at least one second passage for fluids connecting the cavity with the outside of the container, and a liquid-absorbing mass arranged within the cavity. The liquid-absorbing mass acts, after absorption of liquid, as a selective filter prohibiting the passage of liquid, but permits the passage of gas.

BRIEF DESCRIPTION OF THE DRAWINGS

Further characteristics and advantages of the present invention will become apparent from the following detailed description of one preferred embodiment of the invention, illustrated by the accompanying drawings, wherein.

DESCRIPTION OF THE PREFERRED EMBODIMENT

Figure 1:
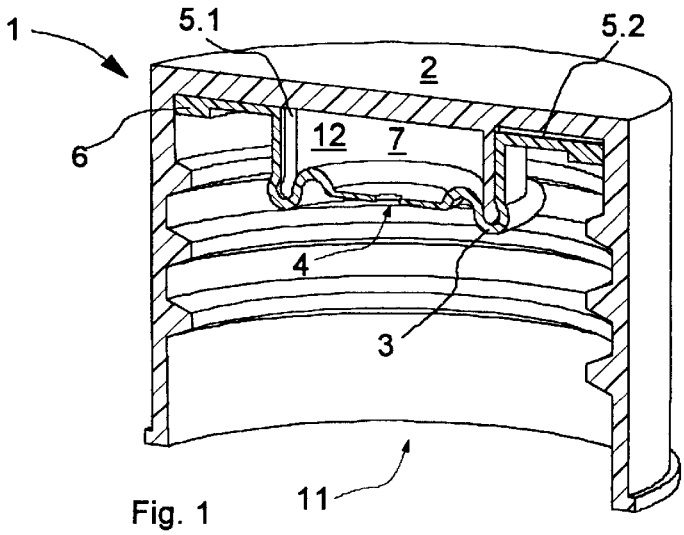
FIG. 1 shows a cross-section through the cap according to the invention in perspective three-dimensional view.

FIG. 1 shows a preferred embodiment of a semipermeable venting cap 1 according to the invention. The cap 1 is preferably made of polypropylene or other thermoplastic or thermo-set materials. An inside 11 of the cap 1, comprises at least one narrow venting channel 5.1, 5.2 restricting the passage of liquid; such venting channels 5.1, 5.2 may also form a network. The inside 11 of the cap 1 is designed to form a cavity 7 for storing a liquid-absorbing mass 8 (see FIG. 2) and the fastening of an undercap 3. In the embodiment shown in FIG. 1, the cavity 7 is formed by a cylindrical ring 12 connected to the cap 1, and the undercap 3 is fitted over the ring 12. The undercap 3 is preferably made of low-density PE or other flexible material. It comprises a venting hole 4 with a diameter in the range of 0.1 to 1.5 mm which is small enough to slow down the passage of liquid contents. A cut or slot or a slot having a length in the range of 2 to 10 mm and a width in the range of width 0.01 to 0.2 mm would also be suitable to serve as the venting hole 4. In the undercap 3 a sealing ring 6 is incorporated to create air-tight sealing between the cap 2 and a container 9 (see FIG. 4).

Figure 2:
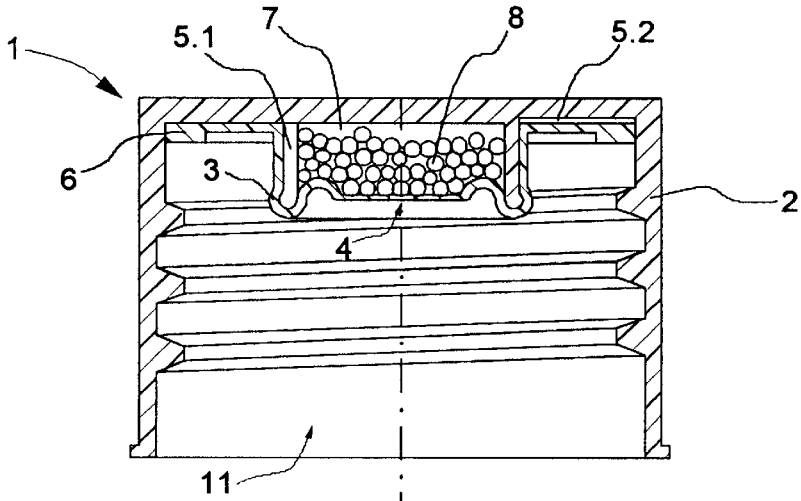
FIG. 2 shows a cross-section through the cap according to the invention in a front view.

FIG. 2 shows the venting cap 1 in a front view. The cavity 7 is filled with the liquid-absorbing mass 8, e.g., water-absorbing polymeric granules. The undercap 3 acts as a cover which prevents the water-absorbing granules 8 from falling out of the cavity 7. The narrow venting channels 5.1, 5.2 are arranged in such a manner that the adjustment of pressure difference by gas flow is supported and the flow of liquid is restricted. The cavity 7 can also be arranged in a different way but it is preferably located in a place where normally it is surrounded by gas. The venting cap 1 permits therefore the selective passage of gases but not of liquids. The water-absorbing granules 8 in the cavity 7 act as a selective filter prohibiting the passage of liquid, but permitting the passage of gas. The following swellable polymers are preferred as liquid absorbing polymeric mass: Crosslinked acrylic acid polymers and copolymers polymerized in organic solvents. Other carboxylic acids and salts used to create such polymers are methacaylic acid, maleic acid and itaconic acid. To improve the rate of water absorbency, these acrylic acid polymers can be polymerized in presence of dispersed nitrogen or $CO_2$ so that polymer porous particles are formed. The liquid-absorbing mass 8 in the cavity 7 preferably has a bulk volume of 5–70% of the volume of the cavity 7.

To further improve the selective free passage of gas, an inert organic or inorganic porous material can be included in the cavity 7. This porous material with a open surface structure creates a continuous network of channels, when in contact to each other. The ensuring of free passage of gas is guaranteed. As an example good results are obtained by the following porous materials: Aluminosilicate molecular sieve with a preferred bulk density of 750 kg/m$^3$, a bead size of 95% between 1 and 0.5 mm and an average pore size of 3 $\mu$m; Porous polyolefin with a preferred bulk density of 300 kg/m$^3$, a bead size of 1–3 mm, a porosity of >50% by volume and an average pore size of 3 $\mu$m.

Figure 3:
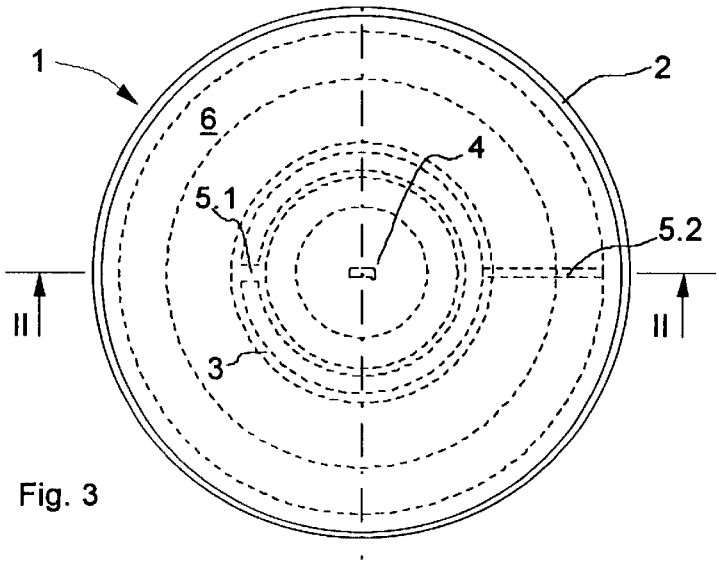
FIG. 3 shows the cap according to the invention in a top view.

FIG. 3 shows the venting cap 1 in a top view. The hidden edges are dashed. The narrow venting channels 5.1, 5.2 connect the cavity 7 with the outer environment of the cap 1. As shown here the narrow channels 5.1, 5.2 are arranged in a way that their existence is not visible from the outside, which may be an advantage due to design reasons. The narrow venting channels 5.1, 5.2 can also be arranged in a different way or have a different design than in the embodiment of FIG. 1. They are optimized as to the liquid stored in the container closed by the cap 1. If more gas has to be transferred, they are designed wider. It is also possible that the narrow channels 5.1, 5.2 are temporarily sealed, if this is necessary. For certain high-quality beverages it is an advantage if they are completely sealed during a certain period. Young wines in bottles as an example need a cap which allows equalization of pressure differences during storing because of gas production. The narrow channels 5.1, 5.2 in a combination with the water-absorbing granules 8 can be designed to guarantee optimal storing to obtain best quality.

Figure 4:
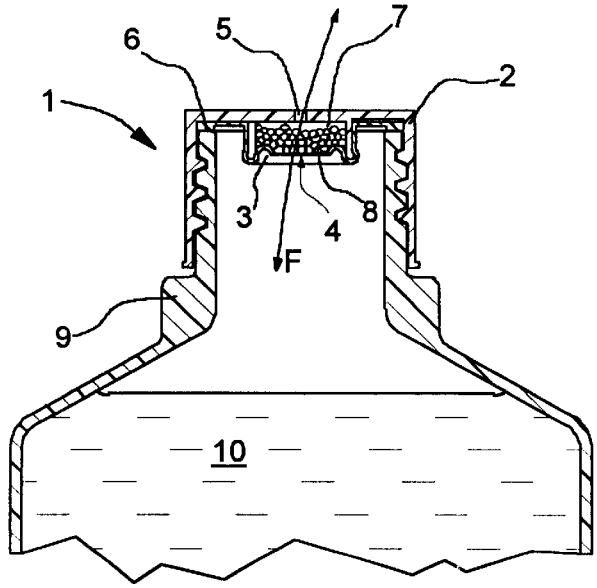
FIGS. 4–6 show the function of the cap according to the invention in three cross-sections.
Figure 5:
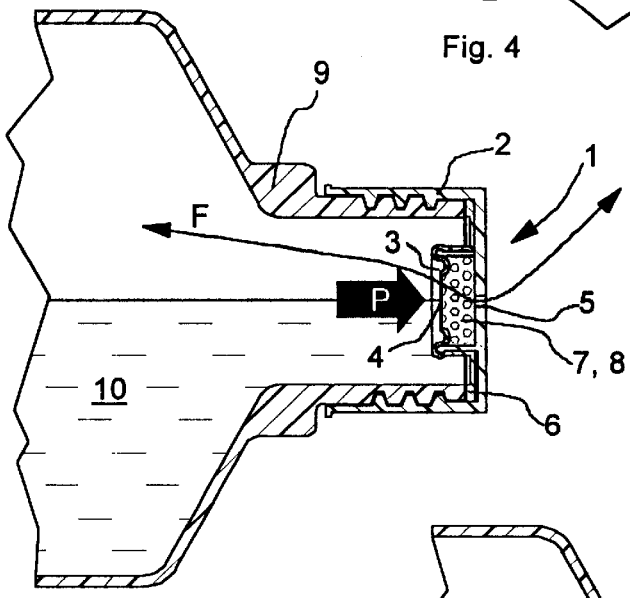
Figure 6:
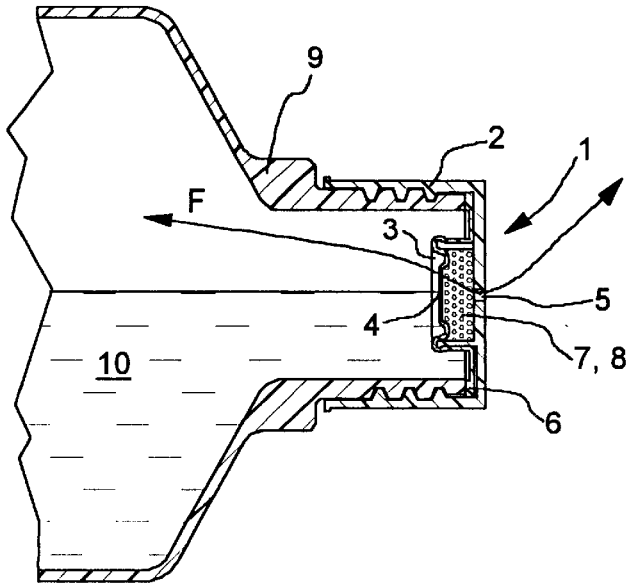

FIGS. 4–6 illustrate the operation of the invention. A container 9 is filled with a liquid product 10 (e.g., a disinfectant solution of hydrogen peroxide) and capped with the venting cap 1. In the embodiment shown in the FIGS. 4–6 an opening 5 has the same function as the narrow channels 5.1, 5.2 of FIGS. 1 and 2. In case where the container 9 is stored upside-down or side-down (see FIG. 5), the liquid 10 starts slowly entering into the cavity 7 through the small opening 4 of the undercap 3. This is displayed by an arrow P. The first small quantity of water solution entering the cavity 7 between cap 2 and undercap 3 swells the granules 8 of polymer, creating a mass which fills the cavity 7. This is displayed in FIGS. 5 and 6, where the water absorbing granules 8 are starting to swell (see FIG. 5) filling the cavity 7 until it is completely filled (see FIG. 6). This swollen mass 8 acts from this point on as selective filter prohibiting the flow of liquid 10, but permitting the passage of gas in both directions, which is indicated by an arrow F.

Another application of this cap is the following. A container 9 is filled with a hot liquid 10 e.g., a hot sauce, and capped with a venting cap 1. With a normal sealing cap (not shown in detail) the walls of the bottle will be deformed after cooling. The use of the venting cap 1 according to the invention will create equalization of outside and inside pressures by permitting air to enter the bottle 9. In case that the bottle is stored side-down, the cap becomes liquid-tight due to the mechanism described in the previous example.

An alternative possibility is the use of the venting cap 1 with already swollen water-absorbing granules 8. A bottle 9 is filled, for an example, with an agrochemical product in organic solvent, e.g., xylene. In case that the liquid-absorbing mass 8 absorbs only water but not xylene, this embodiment would not work. In this case the problem is solved by using the venting cap 1 with pre-swollen water-absorbing granules 8. This is achieved by adding to the cavity 7 of the cap 1 the proper amount of water together with the swollen water-absorbing granules 8 before fastening the undercap 3 to the ring 12.

What is claimed is:

1. A venting cap for a container (9) comprising means defining a cavity (7) having an interior volume;

at least one first fluid passage (4) connecting said cavity (7) with the inside of said container (9);

at least one second fluid passage (5.1, 5.2, 5) connecting said cavity (7) with a region outside said container (9); and a water-absorbing mass (8) of organic granules in said cavity (7), said granules comprising crosslinked carboxylic acid polymers and copolymers polymerized in an organic solvent, said water-absorbing ganules expanding, after absorption of water, to form a selective filter prohibiting the passage of liquid and permitting the passage of gas.

2. A venting cap according to claim 1 wherein said granules of said water-absorbing mass (8) are polymerized in the presence of dispersed nitrogen or $CO_2$ for improving the rate of water absorbency.

3. A venting cap according to claim 1 wherein said water-absorbing mass of granules (8) in said cavity has a bulk volume of 5 to 70% of said volume of said volume of said cavity (7).

4. A venting cap according to claim 1 wherein said first fluid passage (4) is formed so flow of liquid therethrough is slowed.

5. A venting cap according to claim 4 wherein said first fluid passage (4) comprises an opening having a diameter in the range of 0.1 to 1.5 mm.

6. A venting cap according to claim 4 wherein said first fluid passage (4) comprises a slot having a length in the range of 2 to 10 mm and a width in the range of 0.01 to 0.2 mm.

7. A venting cap according to claim 1 including adding water to said cap whereby said liquid absorbing mass (8) is swollen.

8. The venting cap according to claim 1 wherein the carboxylic acid is acrylic acid.

9. The venting cap according to claim 1 wherein the carboxylic acid is selected from the group consisting of methacrylic, maleic acid and itaconic acid.

10. A method of using a venting cap according to claim 1 comprising capping containers for aqueous cleaning fluids, sanitation solutions, agricultural chemicals, cosmetics, food or biological products.

* * * * *